United States Patent [19]

Trotta

[11] 4,057,896

[45] Nov. 15, 1977

[54] RAZOR HANDLE

[75] Inventor: Robert A. Trotta, Winthrop, Mass.

[73] Assignee: The Gillette Company, Boston, Mass.

[21] Appl. No.: 732,467

[22] Filed: Oct. 14, 1976

Related U.S. Application Data

[63] Continuation of Ser. No. 576,252, May 12, 1975, abandoned.

[51] Int. Cl.[2] ..... B26B 21/14; B26B 21/52

[52] U.S. Cl. ..... 30/89; 30/47

[58] Field of Search ..... 30/47, 51, 57, 85, 87, 30/89

[56] References Cited

U.S. PATENT DOCUMENTS

| | | | |
|---|---|---|---|
| 923,579 | 6/1909 | Reed | 30/87 X |
| 978,705 | 12/1910 | Dannacher | 30/51 |
| 1,961,236 | 6/1934 | Merrick | 30/85 X |
| 3,317,995 | 5/1967 | Bord | 30/87 |
| 3,593,416 | 7/1971 | Edson | 30/57 X |
| 3,810,305 | 5/1974 | Perry | 30/47 |
| 3,935,639 | 2/1976 | Terry | 30/47 |
| 3,938,247 | 2/1976 | Carbonell | 30/47 |
| 3,950,849 | 4/1976 | Perry | 30/47 |

*Primary Examiner*—Gary L. Smith

*Attorney, Agent, or Firm*—Richard A. Wise; Oistein J. Bratlie; Donald E. Mahoney

[57] ABSTRACT

A razor handle for a razor blade assembly adapted to be movably mounted on the handle and having cam means thereon for receiving a biasing force, the razor handle having arms with journal means providing an axis about which the razor blade assembly may be pivoted, and cam follower means adapted to engage the cam means on the razor blade assembly for exerting a bias force thereon.

8 Claims, 7 Drawing Figures

Fig. 1
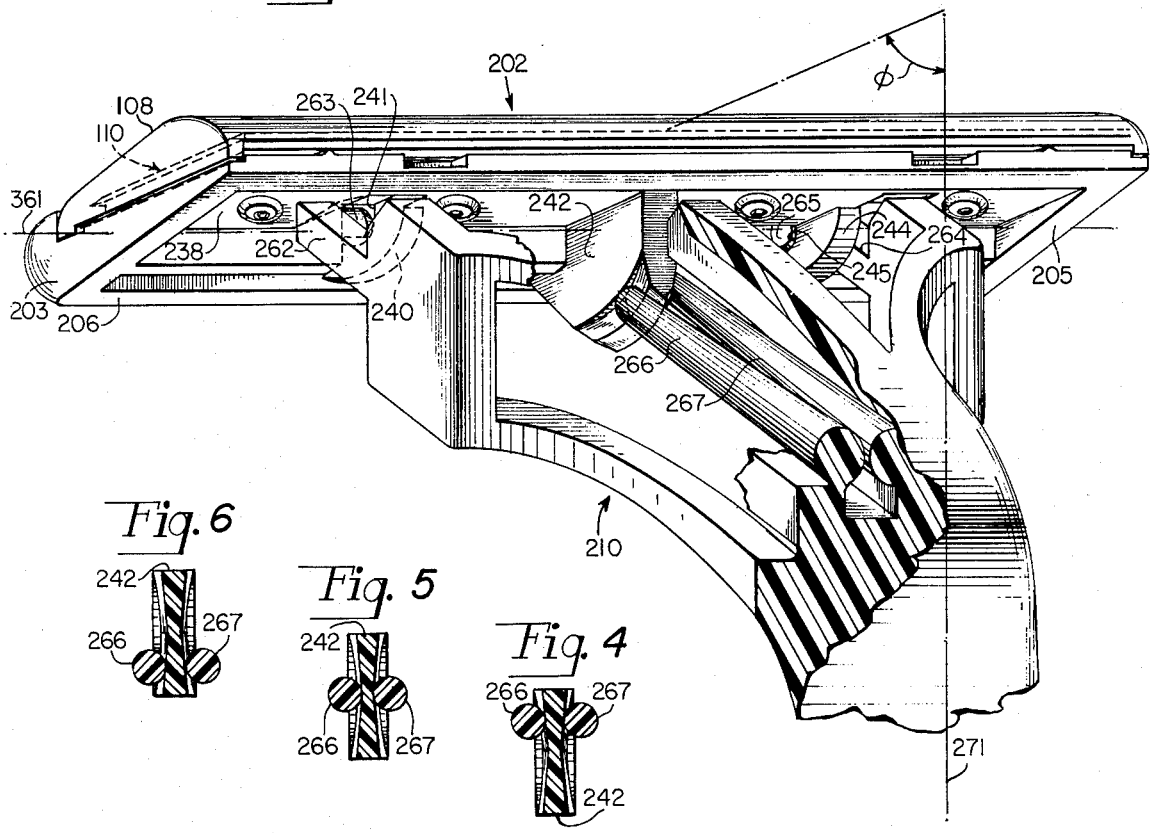
Fig. 6
Fig. 5
Fig. 4
Fig. 2
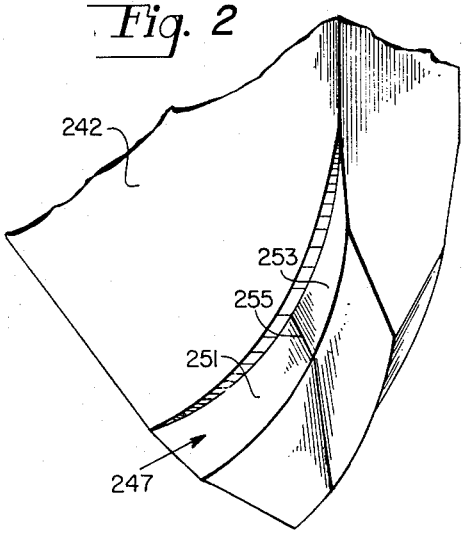
Fig. 3
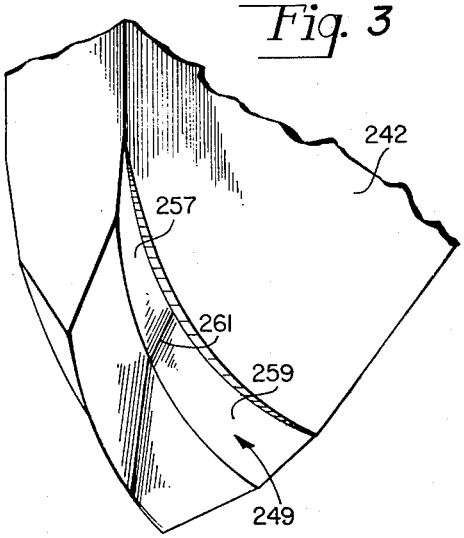

RAZOR HANDLE

This is a continuation of application Ser. No. 576,252, filed May 12, 1975, now abandoned.

BACKGROUND OF THE INVENTION

1. Field of the Invention

This invention relates to wet shaving systems and, more particularly, to a razor handle adapted to be pivotally connected to a razor blade assembly in which a razor blade is secured in a permanent manner to a substantially rigid member, the substantially rigid member having a cam for receiving a biasing force extended by the razor handle.

2. Description of the Prior Art

Safety razors conventionally comprise a guard member and a cap member between which, in use, a disposable razor blade is sandwiched, and a handle—the guard member, the cap member, and the handle—being fixed relative to one another. The latter feature is present in the conventional one-piece and, three-piece razor designed to take disposable, doubleedged blades. Safety razors have recently appeared on the market which comprise, instead of disposable razor blades, a disposable razor blade assembly, or head, having a guard member, one or more blades, and a cap member held rigidly together. The disposable razor blade assembly is rigidly attached to a handle so that the razor edges are at a fixed angular attitude relative to the handle. The blade assembly is replaced as a whole when the razor cutting edge (or edges) becomes blunt.

Continuing efforts are being made to improve the shaving characteristics of such implements and/or to accommodate individual preferences. A factor in shaving efficiency and effectiveness is the orientation of the active components of the shaving system relative to the skin surface being shaved. The surface frequently has undulations or is in a relatively inaccessible or awkward area to reach and the shaving action is reduced in efficiency because the relationship of the active element to the skin surface being shaved significantly departs from the optimum value. Razors in which there is a fixed relationship between the shaving unit and the razor handle call for considerable dexterity on the part of the user and substantial changes in the disposition of the handle in order to maintain the shaving unit at its optimum attitude on the shaver's face, particularly when negotiating areas, such as the jaw line, where there are gross changes in facial contours.

It has been proposed, for example in U.S. Pat. No. 3,593,416, to improve the shaving characteristics of razors by providing a razor handle with a yoke structure and a blade assembly with pins projecting outwardly from opposite ends of the blade assembly. The pins of the blade assembly are received in the handle yoke structure so that the blade assembly may rock relative to the handle. Such proposed arrangement has certain drawbacks and disadvantages, including cumbersome lengthening of the razor yoke structure beyond the ends of the blade assembly.

SUMMARY OF THE INVENTION

An object of the present invention is to provide a razor handle for a razor blade assembly adapted to be movably mounted on the handle and having cam means thereon for receiving a biasing force, the razor handle comprising journal means formed on movable arm portions of the razor handle for receiving the razor blade assembly, and cam follower means adapted to engage the cam means on the razor blade assembly for exerting a biasing force thereon.

BRIEF DESCRIPTION OF THE DRAWINGS

FIG. 1 is a perspective view, partially cut-away, of one form of a razor handle assembly, illustrative of an embodiment of the invention shown attached to a razor blade assembly.

FIGS. 2 and 3 are isometric drawings of a cam member portion of the razor handle assembly of FIG. 1.

FIGS. 4, 5, and 6 are cross-sectional drawings of a cam member portion of the razor handle assembly of FIG. 1.

DESCRIPTION OF THE PREFERRED EMBODIMENT

Figure 7:
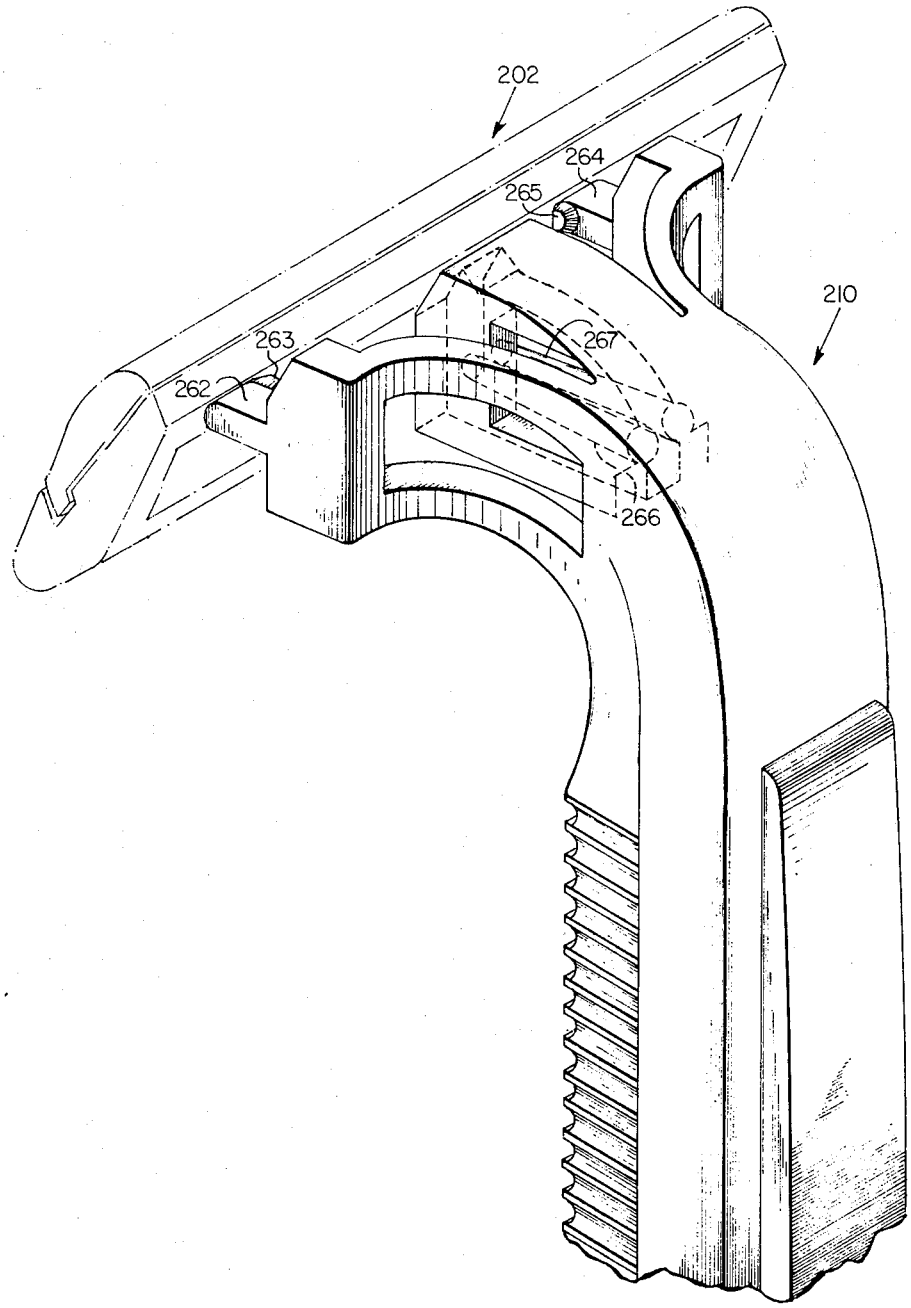
FIG. 7 is a perspective view of the razor handle assembly shown in FIG. 1.

Referring to FIG. 1, there is shown a perspective view, partially cut-away, of a razor blade assembly 202 attached to a razor handle 210. The razor blade assembly 202 has a substantially rigid platform member 206, a cap member 108, and blade means 110 comprising one or more blade members disposed between the platform member 206 and the cap member 108. In the razor blade assembly 202, the platform member 206 is provided with support members 240 and 244 and a cam member 242 molded integrally with the platform member 206. The support members 240 and 244 and the cam member 242 extend from a platform underside 238 and are located intermediate shaving unit ends 203 and 205. Apertures 241 and 245 in the support members 240 and 244 provide journal bearings for opposing journals 263 and 265 disposed on arms 262 and 264 on the razor handle 210. The arms 262 and 264 are molded integrally with the razor handle assembly 210 and are formed from rigid material having a degree of flexibility, such as plastic, so that in manufacture the journal 263 may be moved into the aperture 241 and the journal 265 may be moved into the aperture 245 by flexing of the arms 262, 264.

The cam member 242 has a plurality of cam surfaces 247, as shown in FIG. 2, and 249, as shown in FIG. 3. The cam surface 247 is formed by oppositely inclined surfaces 251 and 253 which intersect to form a dihedral angle with an apex 255. The cam surface 249 is formed by oppositely inclined surfaces 257 and 259 which intersect to form a dihedral angle with an apex 261. The journal bearings 241 and 245 have axes aligned with each other to provide a pivot axis 361 (FIG. 1) located above the apex 261 and the apex 255. Thus, the pivot axis 361 is closer to the platform underside 238 than either the apex 255 or the apex 261.

The razor handle assembly 210 has, in addition to the opposing journals 263 and 265, a cam follower assembly comprising first and second cam follower members 266 and 267 in the form of flexible rods, formed from material such as plastic, and molded integrally with the razor handle assembly 210. The razor blade assembly 202 is attached to the razor 210 by inserting the journals 263 and 265 into the journal bearings 241 and 245 and arranging the cam member 242 to engage both the cam follower members 266 and 267, as shown in FIGS. 4, 5, and 6. The cam member 242 normally engages the cam follower member 266 at the apex 255 and the cam follower member 267 at the apex 261, as shown in FIG. 5.

The cam member 242 and the cam follower members 266 and 267, cooperatively urge the blade means 110 in the razor blade assembly 202 to be in a plane at a desired angular attitude, $\phi$; relative to razor longitudinal axis 271.

An illustrative example of a razor handle assembly comprising a pair of arms and a cam follower assembly cooperatively connected to a razor blade assembly has been disclosed. Numerous and varied other arrangements can readily be devised in accordance with the disclosed principles.

What is claimed as new and desired to be secured by Letters Patent of the United States is:

1. A razor handle for a razor blade assembly adapted to be movably mounted on said handle and having cam means thereon for receiving a biasing force from said handle, said razor handle comprising:

pivot mounting means disposed on arm portions of said razor handle; and first and second cam follower means having portions extending from said razor handle and adapted to engage said cam means of said razor blade assembly and to simultaneously move for exerting biasing force thereon, said extending portion of said first cam follower means having a longitudinal axis substantially parallel to a longitudinal axis of said extending portion of said second cam follower means.

2. A razor handle according to claim 1, wherein said arms and said cam follower means are of plastic and are molded integrally with the remainder of said razor handle.

3. A razor handle for a razor blade assembly adapted to be movably mounted on said handle and having first and second cam means thereon for receiving a biasing force, said razor comprising:

pivot mounting means diposed on arm portions of said handle;

first cam follower means having a portion extending from said razor handle and adapted to engage said first cam means of said razor blade assembly for exerting biasing force thereon; and second cam follower means having a portion extending from said razor handle and adapted to engage said second cam means of said razor blade assembly for exerting biasing force thereon, said first and second cam follower means being adapted to simultaneously move for exerting said biasing force on said first and second cam means, said extending portion of said first cam follower means having a longitudinal axis substantially parallel to a longitudinal axis of said extending portion of said second cam follower means.

4. A razor handle according to claim 3, wherein said first and second cam follower means are flexible rods.

5. A razor handle for a razor blade assembly adapted to be movably mounted on said razor handle and having first cam means with intersecting surfaces forming a first single angle and second cam means with intersecting surfaces forming a second angle, said razor handle comprising:

pivot mounting means disposed on arm portions of said razor handle;

first cam follower means having a portion extending from said razor handle and adapted to engage said first cam means of said razor blade assembly at said first angle for exerting biasing force thereon; and second cam follower means having a portion extending from said razor handle and adapted to engage said second cam means of said razor blade assembly at said second angle for exerting biasing force thereon, said first and second cam follower means being adapted to simultaneously move for simultaneously exerting said biasing force on said first and second cam means, said extending portion of said first cam follower means having a longitudinal axis substantially parallel to a longitudinal axis of said extending portion of said second cam follower means.

6. A razor handle according to claim 5, wherein said pivot mounting means are opposing journals.

7. A razor handle according to claim 5, wherein said first and second cam follower means are first and second flexible rods.

8. A razor handle according to claim 7, wherein said first flexible rod has a longitudinal axis substantially parallel to a longitudinal axis of said second flexible rod.

* * * * *